US009512806B2

(12) United States Patent
Osburg

(10) Patent No.: US 9,512,806 B2
(45) **Date of Patent: *Dec. 6, 2016**

(54) INTERNAL COMBUSTION ENGINE HAVING A STARTER DEVICE

(71) Applicant: Andreas Stihl AG & Co. KG, Waiblingen (DE)

(72) Inventor: Gerhard Osburg, Kernen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 282 days.

This patent is subject to a terminal disclaimer.

(21) Appl. No.: 14/299,760

(22) Filed: Jun. 9, 2014

(65) Prior Publication Data

US 2014/0360466 A1 Dec. 11, 2014

(30) Foreign Application Priority Data

Jun. 8, 2013 (DE) ..... 10 2013 009 668

(51) Int. Cl.

| | |
|---|---|
| ***F02M 1/02*** | (2006.01) |
| ***F02B 25/20*** | (2006.01) |
| ***F02M 19/10*** | (2006.01) |
| ***F02M 19/12*** | (2006.01) |

(52) U.S. Cl.

CPC ..... *F02M 1/02* (2013.01); *F02B 25/20* (2013.01); *F02M 19/10* (2013.01); *F02M 19/124* (2013.01)

(58) Field of Classification Search

CPC ..... F02M 1/02; F02M 1/08; F02M 7/26; F02M 19/124; F02M 9/00; F02M 9/06; F02M 9/065;F02M 9/08; F02M 9/085; F02D 41/062; F02D 2011/101; F02D 2011/103; F02B 63/02

See application file for complete search history.

(56) References Cited

U.S. PATENT DOCUMENTS

| | | | | |
|---|---|---|---|---|
| 3,709,469 A | | 1/1973 | Edmonston et al. | |
| 5,942,160 A | | 8/1999 | Araki | |
| 6,000,683 A | * | 12/1999 | Van Allen | F02M 1/02 123/179.18 |
| 6,142,455 A | | 11/2000 | Araki | |
| 6,231,033 B1 | | 5/2001 | Araki | |

(Continued)

FOREIGN PATENT DOCUMENTS

JP 2005-282554 A 10/2005

*Primary Examiner* — Hung Q. Nguyen
*Assistant Examiner* — Xiao Mo
(74) *Attorney, Agent, or Firm* — Walter Ottesen, P.A.

(57) ABSTRACT

An internal combustion engine has a supply channel supplying combustion air. A throttle element is arranged in the supply channel and the position of the throttle element is adjustable by an operator-controlled element. The engine has a starter device which has an operating position and a starting position. In the starting position, the starter device opens up a defined flow cross section in the supply channel. The starter device locks in the starting position. The locking is released by actuation of the operator-controlled element. To achieve good starting performance of the engine, the engine has an intermediate stop which, upon the first actuation of the operator-controlled element after the release of the locking, is active and prevents the throttle element from opening fully, and which, during the subsequent closing movement of the throttle element, is deactivated such that the throttle element can be opened fully.

19 Claims, 9 Drawing Sheets

(56) References Cited

U.S. PATENT DOCUMENTS

| | | | | |
|---|---|---|---|---|
| 6,494,439 | B1 * | 12/2002 | Collins | F02M 1/02 261/52 |
| 6,641,118 | B2 | 11/2003 | Schliemann | |
| 7,261,280 | B2 | 8/2007 | Takano et al. | |
| 7,404,546 | B2 | 7/2008 | Prager et al. | |
| 7,431,271 | B2 * | 10/2008 | Gantert | F02M 1/02 261/52 |
| 7,475,871 | B2 | 1/2009 | Terakado et al. | |
| 7,490,587 | B2 | 2/2009 | Rosskamp et al. | |
| 7,611,131 | B2 | 11/2009 | Engman et al. | |
| 7,913,659 | B2 | 3/2011 | Maupin | |
| 8,783,232 | B2 | 7/2014 | Veerathappa et al. | |
| 9,068,533 | B2 | 6/2015 | Kullik et al. | |
| 2006/0170120 | A1 | 8/2006 | Takano et al. | |
| 2008/0121208 | A1 | 5/2008 | Rosskamp et al. | |
| 2008/0246170 | A1 | 10/2008 | Engman et al. | |
| 2011/0146610 | A1 * | 6/2011 | Reichler | F02N 11/10 123/179.28 |
| 2012/0138326 | A1 | 6/2012 | Schlauch et al. | |

* cited by examiner

INTERNAL COMBUSTION ENGINE HAVING A STARTER DEVICE

CROSS REFERENCE TO RELATED APPLICATION

This application claims priority of German patent application no. 10 2013 009 668.5, filed Jun. 8, 2013, the entire content of which is incorporated herein by reference.

BACKGROUND OF THE INVENTION

U.S. Pat. No. 7,431,271 discloses a carburetor for the supply of combustion air to an internal combustion engine. The carburetor has a starter device which fixes a throttle flap and a choke flap of the carburetor in a structurally predefined position inclined with respect to the intake duct longitudinal axis. The fixing of the flaps in the starting position is realized by means of locking between a throttle lever, which is coupled to the throttle flap, and a choke lever, which is coupled to the choke flap. The locking can be eliminated by applying power. To achieve a further enrichment of the fuel/air mixture supplied to the internal combustion engine upon the first application of power after starting, there is provided on the throttle lever a lug which holds the choke flap in a partially open position.

SUMMARY OF THE INVENTION

It is an object of the invention to provide an internal combustion engine having a starter device of the kind referred to above which exhibits economical operating performance during starting and directly after starting.

The internal combustion engine of the invention includes: an operator-controlled element; a supply channel for supplying combustion air for the engine; a throttle element mounted in the supply channel; the operator-controlled element being operatively connected to the throttle element to adjust the position thereof; a starter device having an operating position and a starting position; the starter device being configured to enable a defined clear flow cross section in the supply channel in the starting position; a latching unit for latching the starter device in the starting position; the operator-controlled element being operatively connected to the latching unit for unlatching the latching unit in response to an actuation of the operator-controlled element; an intermediate stop configured to be active in response to a first actuation of the operator-controlled element after the latching unit is unlatched so as to prevent a full opening of the throttle element; and, the intermediate stop being further configured to be deactivated in response to a follow-on closing movement of the throttle element so as to permit the throttle element to be fully opened.

After the starting of the internal combustion engine, the starting position of the starter device is eliminated by actuation of an operator-controlled element, in particular by application of power. The starter device is thereby adjusted into its operating position. In the process, the free flow cross section of the supply channel is increased abruptly. To prevent excess leaning of the mixture, and thus adverse operating performance or stalling of the engine, upon the actuation of the operator-controlled element directly following the starting process, that is, upon that actuation of the operator-controlled element which causes the locking of the starter device to be eliminated, an intermediate stop is provided for the throttle element. Upon the first actuation of the operator-controlled element after the elimination of the locking, the intermediate stop is active and prevents the throttle element from opening fully. During the subsequent closing movement of the throttle element, the intermediate stop is deactivated such that the throttle element can be opened fully during a subsequent opening movement. It is thus possible in a targeted manner to realize an enrichment of the mixture after the starting process. By virtue of the intermediate stop being deactivated during normal operation, the internal combustion engine can be calibrated so as to be relatively lean, and low exhaust-gas values can be achieved. Here, the intermediate stop may be deactivated at any time during the closing movement of the throttle element up to the point at which the fully closed position of the throttle element is reached. It is particularly advantageous for the intermediate stop to be deactivated toward the end of the closing movement, in particular directly before the fully closed position of the throttle element is reached.

The intermediate stop may be an intermediate stop that is designed to be activated and deactivated mechanically. Provision may however also be made for the intermediate stop to be activated electrically, for example by means of a corresponding actuator. Some other form of activation of the intermediate stop, for example hydraulic or pneumatic, may also be advantageous.

The starter device advantageously has an actuating element that is designed to be actuated by the operator. The actuating element is for example a lever or actuating button for engagement of the starting position. The intermediate stop is advantageously formed by a first stop element which is connected to the actuating element and which interacts with a second stop element connected to the throttle element. This yields a simple construction. The starter device can advantageously be adjusted from the operating position into the starting position by rotation of the actuating element about an actuation axis and displacement of the actuating element in the direction of the actuation axis. This yields simple actuation. At the same time, owing to the two independent actuation movements, an inadvertent actuation of the choke is prevented. Here, provision may be made both for the actuating element to be initially rotated and subsequently adjusted in the direction of the actuation axis and for the actuating element to be initially adjusted in the direction of the actuation axis and then rotated. The sequence of the two operating steps is advantageously structurally predefined. To keep the intermediate stop active, provision is advantageously made for the actuating element to be moved at most partially in the direction of the operating position during the elimination of the locking. The actuating element may accordingly move partially in the direction of the operating position or remain in the position associated with the starting position. In the starting position, the starter device advantageously holds the throttle element in a partially open position. It is thereby possible in a simple manner to realize an enrichment of the mixture for the starting process. After the elimination of the locking, the throttle element advantageously moves back into the operating position, independently of the movement of the actuating element.

The internal combustion engine advantageously has a first guide assigned to the intermediate stop. The guide advantageously keeps the intermediate stop active, after the elimination of the locking, until the subsequent closing movement of the throttle element. It is thereby possible in a simple manner to realize a mechanical activation and deactivation of the intermediate stop. It may be provided that the intermediate stop is a first intermediate stop and that at least one second intermediate stop is provided which is assigned to a second guide. Here, the second intermediate stop is advantageously active, after the deactivation of the first stop, until a subsequent closing movement of the throttle element. Further guides with associated intermediate stops may also be advantageous. By means of two or more guides each with an associated intermediate stop, the maximum degree of opening of the throttle element can be adjusted over multiple actuation processes of the operating element. The guides are in this case arranged in succession in a cascaded fashion, specifically such that, during every closing movement of the throttle element, the active intermediate stop is deactivated and a subsequent guide with a next intermediate stop is activated. The number of guides and intermediate stops connected in series is in this case also advantageously configured for the intended use of the internal combustion engine.

A fuel opening advantageously issues into the supply channel, and the at least one guide is in the form of a ramp which controls the free flow cross section of the fuel opening as a function of the position of the throttle element. By virtue of the supplied fuel flow rate being controlled by means of a ramp, it is possible to adjust not only the maximum possible degree of opening of the throttle element upon the first opening of the throttle element after the starting process but also the fuel flow rate supplied to the intake duct. In this case, the supplied fuel flow rate is advantageously increased in relation to the fuel flow rate supplied during normal operation. For this purpose, it is provided that the intermediate stop is formed on a first ramp and that the free flow cross section of the fuel opening after the deactivation of the intermediate stop is coupled, by means of a second ramp, to the position of the throttle element, wherein the flow cross section set by means of the second ramp is smaller than a flow cross section set, for the same position of the throttle element, by means of the first ramp.

The internal combustion engine advantageously has a guide element which, upon the first actuation of the operator-controlled element after the elimination of the locking, interacts with the first guide. To deactivate the intermediate stop, it is provided that the guide element moves out of the first guide, and thereby deactivates the intermediate stop, during the closure of the throttle element following the first actuation of the operator-controlled element. In this way, the intermediate stop can be mechanically deactivated in a simple manner.

It is advantageously the case that, in the starting position, the starter device increases the fuel flow rate supplied into the supply channel. The starter device accordingly acts not only on the free flow cross section of the supply channel but additionally on the supplied fuel flow rate. It is advantageously the case that an adjustment needle which controls the supplied fuel flow rate projects into the fuel opening. The starter device advantageously acts on the position of the adjustment needle and, in the starting position, increases the size of the free flow cross section in the fuel opening. Here, the throttle element is in particular a control drum mounted so as to be rotatable about a pivot axis. The carburetor is accordingly a drum-type carburetor. The adjustment needle is advantageously held on the control drum, and the actuating element of the starter device moves the control drum in the longitudinal direction of its pivot axis.

Provision may however also be made for the carburetor to be a flap-type carburetor and for the throttle element to be a throttle flap, wherein a choke flap is provided upstream of the throttle flap, and wherein the starter device acts on the position of the choke flap and on the position of the throttle flap. An electrically actuated valve, in particular an electromagnetic valve, may be provided for controlling the fuel flow rate supplied to the supply channel. The carburetor may be a diaphragm-type carburetor in which the fuel flow rate supplied to the intake duct is dependent on the pressure in a regulating chamber that is charged with a reference pressure.

The internal combustion engine advantageously has a first supply duct for the supply of combustion air and a second supply duct for the supply of combustion air and fuel. In this case, the internal combustion engine is in particular a two-stroke engine that operates with a scavenging gas shield. The throttle element advantageously controls the first supply duct and the second supply duct. Here, in the carburetor, the supply channel is advantageously divided at least partially into the first and the second supply channel. Provision may however also be made for the first and second supply channels to be formed as completely separate ducts, for the throttle element to control the second supply channel, and for an additional throttle element to be arranged in the first supply duct. The position of the additional throttle element is in particular coupled to the position of the throttle element in the second supply duct.

The position of the intermediate stop is, in particular, adjustable. In this way, tuning of the running behavior of the internal combustion engine after the starting process can be realized in a simple manner.

It is advantageously the case that, in the operating position, the starter device does not change the free flow cross section in the supply channel. In the operating position of the starter device, the free flow cross section is advantageously controlled by way of the position of the throttle element, which adjusts the free flow cross section between a minimum and a maximum flow cross section as a function of the position of the operator-controlled element. Within the structurally predefined limits for the adjustable flow cross section, the flow cross section can be adjusted independently of the starter device. The minimum flow cross section may in this case also be determined by elements of the starter device, for example by a choke element. Accordingly, a choke flap that serves as choke element can, in its fully open position, that is, in its operating position, reduce the free flow cross section in the supply channel in relation to an arrangement without a choke element. The flow cross section may in this case be reduced for example by the cross-sectional area of the choke flap itself, in particular in the event of the choke flap being inclined slightly in relation to the supply channel longitudinal axis, by a bearing shaft of the choke flap, by one or more fastening elements by which the choke flap is fixed to the bearing shaft, or by flow guiding elements or the like that are held on the choke flap or on the choke shaft. In the operating position of the starter device, however, the position of the choke element does not change, such that the free flow cross section can be adjusted by means of the operator-controlled element alone, and is dependent only on the position of the throttle element.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
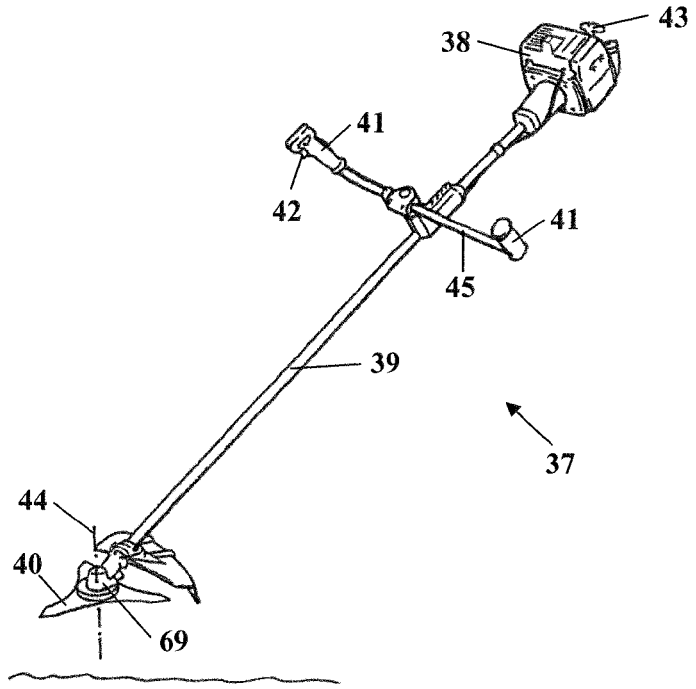
FIG. 1 is a schematic perspective illustration of a brushcutter.
Figure 2:
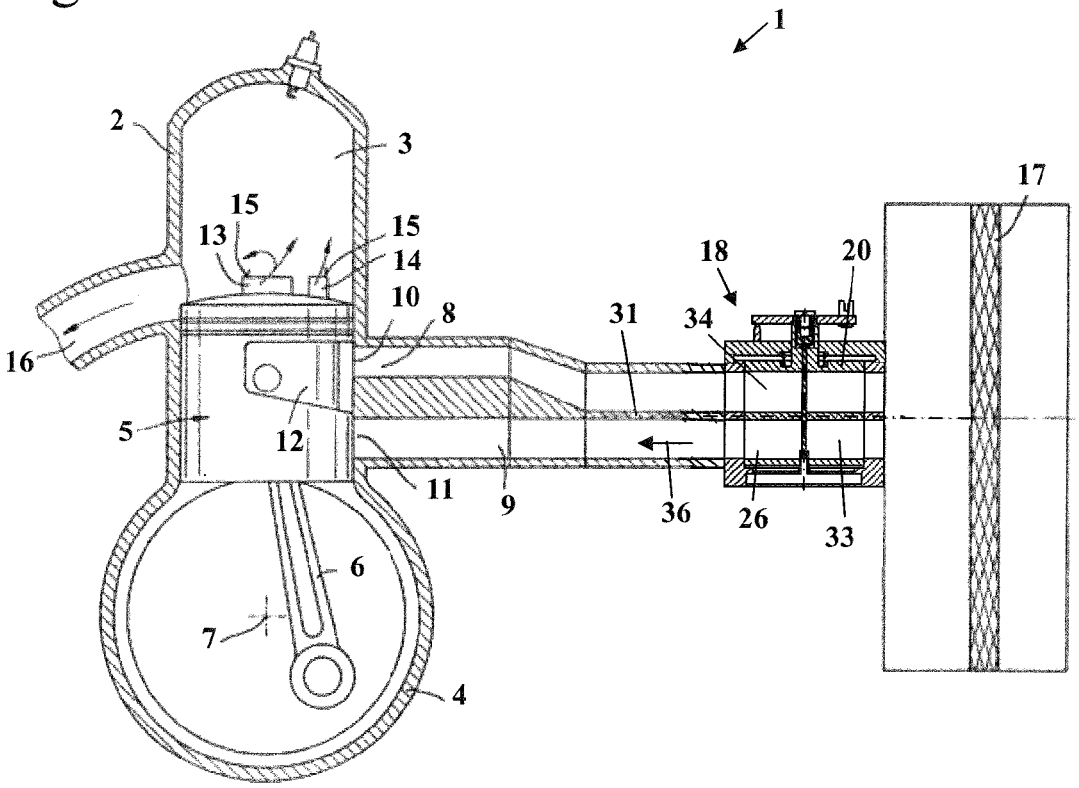
FIG. 2 is a schematic sectional illustration of the internal combustion engine of the brushcutter from FIG. 1.

FIG. 1 shows a brushcutter 37 as an exemplary embodiment of a handheld working apparatus. The internal combustion engine on which the present invention is based may however also be used in other handheld working apparatuses such as, for example, power saws, angle grinders, blowers, hedge trimmers, harvesting equipment or the like. The brushcutter 37 has a housing 38 in which the internal combustion engine 1 shown in FIG. 2 is arranged. A starter handle 43 projects out of the housing 38. The starter handle serves for the actuation of a starter device, for example of a pull starter of the internal combustion engine 1. The housing 38 is connected via a guide tube 39 to a gear head 69. In the guide tube 39 there is guided a drive shaft which is driven in rotation by the drive engine and which drives a tool 40, which is arranged on the gear head 69, in rotation about an axis of rotation 44. In the exemplary embodiment, the tool 40 is a blade.

For guiding the brushcutter 37 during operation, a guide bar 45 is fixed to the guide tube 39. The guide bar has two handles 41. An operator-controlled element 42 is arranged on one of the handles 41. The operator-controlled element 42 is mounted pivotably on the handle 41 and is in the form of a throttle-control lever. The operator-controlled element 42 serves for the control of the combustion air flow rate supplied to the internal combustion engine 1.

FIG. 2 schematically shows the internal combustion engine 1. In the exemplary embodiment, the internal combustion engine 1 is in the form of a two-stroke engine that operates with a scavenging gas shield (advance air). The internal combustion engine 1 may however also operate without a scavenging gas shield. The internal combustion engine 1 may also be a four-stroke engine, preferably a mixture-lubricated four-stroke engine.

The internal combustion engine 1 has a cylinder 2 in which a combustion chamber 3 is formed. The combustion chamber 3 is delimited by a piston 5 which is mounted in the cylinder 2 so as to perform a reciprocating movement. Via a connecting rod 6, the piston 5 drives a crankshaft 7, which is rotatably mounted in a crankcase 4, in rotation. In the region of the bottom dead center of the piston 5 shown in FIG. 2, the interior of the crankcase 4 is connected via flow transfer channels (13, 14) to the combustion chamber 3. The flow transfer channels (13, 14) pass into the combustion chamber 3 by way of flow transfer windows 15. An outlet 16 leads out of the combustion chamber 3 and is open when the piston 5 is in the region of bottom dead center.

For the supply of combustion air, the internal combustion engine 1 has an intake channel 26 which draws in combustion air via an air filter 17. The intake channel 26 is divided by a partition wall 31 into a first supply duct 8 for the supply of substantially fuel-free air and a second supply duct 9 for the supply of fuel/air mixture. For the formation of mixture, the combustion air that is drawn in has fuel supplied to it in a carburetor 18. In the exemplary embodiment, the carburetor 18 is in the form of a drum-type carburetor and has a control drum 20 in which an air duct section 34 and a mixture duct section 33 are formed. The combustion air and the fuel/air mixture flow in a flow direction 36 from the air filter 17 to the cylinder 2 of the internal combustion engine.

The first supply duct 8 opens out at an air inlet 10 on the cylinder 2. The piston 5 has at least one piston pocket 12 in the form of a depression on the outer side of the piston 5. When the piston 5 is in the region of bottom dead center, the air inlet 10 is connected via the piston pocket 12 to at least one of the flow transfer windows 15. In this way, substantially fuel-free combustion air from the first supply duct 8 can pass, as advance air, into the flow transfer channels 13 and 14. The second supply duct 9 opens out at a mixture inlet 11 on the cylinder 2. The mixture inlet 11, like the air inlet 10, is subjected to slot control by the piston 5 and, when the piston 5 is in the region of top dead center, is connected to the interior of the crankcase 4. During operation, when the piston 5 is situated in the region of top dead center, fuel/air mixture is drawn into the crankcase 4 via the second supply duct 9 and the mixture inlet 11. Substantially fuel-free combustion air from the first supply duct 8 can pass, as advance air, into the flow transfer channels 13 and 14 via the piston pocket 12.

During the downward stroke of the piston 5, that is, during the movement of the piston 5 in the direction of the crankcase 4, the fuel/air mixture in the crankcase 4 is compressed. Before the piston 5 reaches bottom dead center, the flow transfer windows 15 open to the combustion chamber 3. Via the flow transfer channels (13, 14), substantially fuel-free air initially flows into the combustion chamber 3 and scavenges exhaust gases from a preceding engine cycle are discharged through the outlet 16. Fresh fuel/air mixture subsequently flows in behind from the interior of the crankcase 4. During the subsequent upward stroke of the piston 5, the piston 5 closes initially the flow transfer windows 15 and subsequently the outlet 16. The piston 5 then compresses the fuel/air mixture in the combustion chamber 3 until the mixture is ignited when the piston 5 is in the region of top dead center. Owing to the subsequent combustion, the piston 5 is accelerated toward the crankcase 4. When the outlet 16 opens, the exhaust gases flow out of the combustion chamber 3. The flow transfer windows 15 subsequently open. The substantially fuel-free air entering the combustion chamber 3 via the flow transfer windows 15 scavenges the exhaust gases out of the combustion chamber 3 before the fresh mixture from the crankcase 4 flows into the combustion chamber 3 for the next engine cycle.

Figure 3:
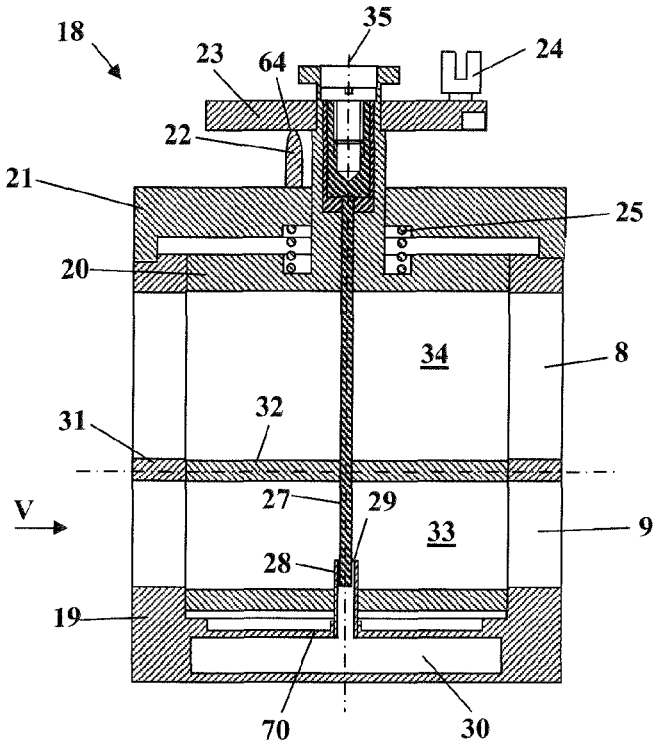
FIG. 3 is a schematic, in section, of the carburetor of the brushcutter from FIG. 1.
Figure 6:
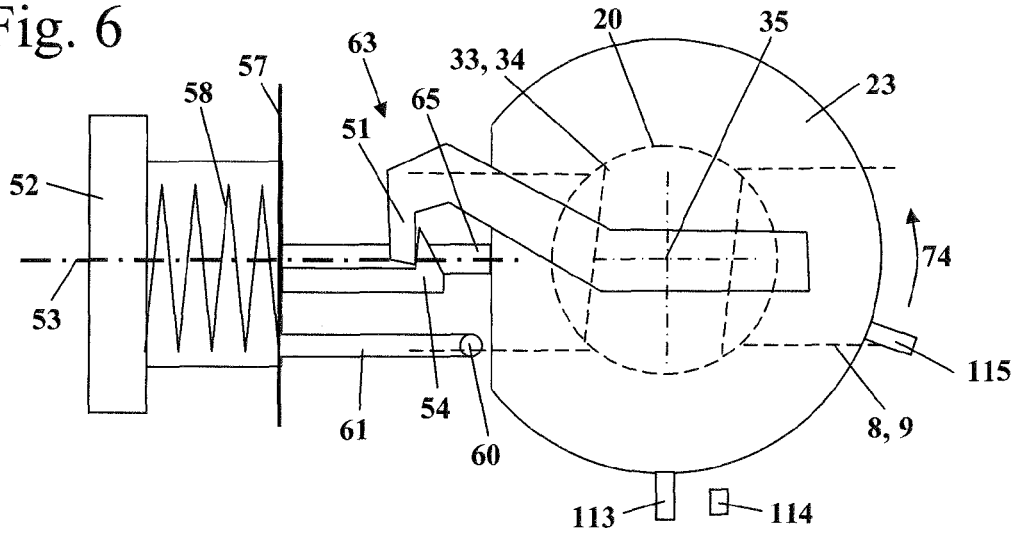
FIG. 6 shows a schematic plan view of the arrangement from FIG. 5 in the direction of the arrow VI in FIG. 5.

FIG. 3 shows the construction of the carburetor 18 in detail. The carburetor 18 has a carburetor housing 19 in which the control drum 20 is mounted so as to be pivotable about a pivot axis 35. Here, the control drum 20 has a first stop which defines the closed position of the control drum 20. The first stop, shown schematically in FIG. 6, may be formed by a first stop part 113 which is connected to the control drum 20 and which interacts with a second stop part 114 held on the carburetor housing 19. A second stop of the control drum 20 is assigned to the fully open position of the control drum 20. The second stop, which is likewise schematically shown in FIG. 6, is formed by a third stop part 115 which is connected to the control drum 20 and which interacts with the second stop part 114. The first and the second stop may also be formed or arranged differently, for example by way of corresponding stop elements on the operator-controlled element. When the control drum 20 is in the fully closed position, a small cross section of at least one of the supply ducts (8, 9) may remain open. When the control drum 20 is in the fully open position, a small cross section of at least one of the supply ducts (8, 9) may remain closed by the control drum 20 such that the control drum 20, even in its fully open position, reduces the flow cross section of the at least one supply duct (8, 9).

As shown in FIG. 3, there is fixed to the control drum 20 an actuating plate 23 which is arranged outside the carburetor housing 19. On the actuating plate 23 there is formed a ramp 64 which interacts with a guide lug 22. The guide lug 22 is fixedly connected to the carburetor housing 19. In the exemplary embodiment, the guide lug 22 is held on a cover 21 of the carburetor housing 19.

The illustration in FIG. 3 is in this case a schematic and shows the function but not the structural arrangement of the elements with respect to one another. The guide lug 22 and the ramp 64 may also be provided between the control drum 20 and the carburetor housing 19, preferably between a base 70, which faces away from the cover 21, of the carburetor housing 19 and the control drum 20. The ramp 64 is designed such that the carburetor drum 20, when it rotates about the pivot axis 35, moves in the longitudinal direction of the pivot axis 35. The carburetor drum 20 has an adjustment needle 27 which projects into a fuel opening 28.

Between the fuel opening 28 and the adjustment needle 27 there is formed an annular gap 29 through which fuel emerges into the second supply duct 9. The control drum 20, as it is rotated from the fully closed position to the fully open position, is moved in the direction of the pivot axis 35 such that the adjustment needle 27 is pulled out of the fuel opening 28, whereby the free flow cross section of the annular gap 29 is enlarged and the fuel flow rate supplied to the second supply duct 9 is increased.

The control drum 20 is subjected to spring loading by a pressure or compression spring 25, and the compression spring 25 pushes the control drum 20 in the direction of its fully closed position. Instead of the compression spring 25, it is also possible for a spring to be provided which acts in the direction of rotation of the control drum 20. As is also shown in FIG. 3, there is provided on the actuating plate 23 an actuating lug 24 which serves for the attachment of a Bowden cable which is connected to the operator-controlled element 42. The control drum 20 has a partition wall section 32 which extends as an extension of the partition wall 31 and which partitions the mixture duct section 33 in the control drum 20 from the air duct section 34. As is also schematically shown in FIG. 3, the fuel opening 28 is connected to a fuel chamber 30. The fuel chamber 30 may, for example, be the regulating chamber of a carburetor 18 in the form of a diaphragm-type carburetor.

Figure 4:
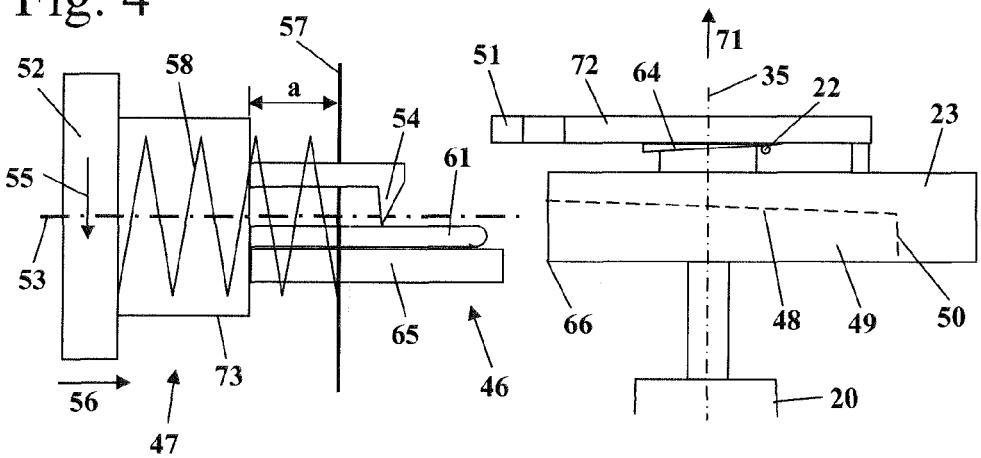
FIG. 4 is a schematic of the starter device of the carburetor from FIG. 3 in an operating position.

For the starting of the internal combustion engine 1, the brushcutter 37 has a starter device 46 which is schematically shown in FIG. 4. In FIG. 4, the starter device 46 is arranged in an operating position 47. In this position, the control drum 20 that is schematically indicated in FIG. 4 can be freely rotated between the fully open position and the fully closed position as a function of the position of the operator-controlled element 42 between its two stops. In its operating position 47, the starter device 46 does not change the free flow cross section in the supply ducts 8 and 9.

FIG. 4 also shows the configuration of the ramp 64. The ramp 64 has a ramped profile. If the control drum 20 is rotated about the pivot axis 35, the ramp 64 moves along the guide lug 22, wherein the height of the ramp 64, that is, the spacing between the actuating plate 23 and the area of contact between the guide lug 22 and the ramp 64, increases. As a result, the control drum 20 moves in the direction of the pivot axis 35, as indicated by the arrow 71.

The actuating plate 23 has a depression 49 on which a ramp 48 is formed. At its end, the depression 49 forms a stop element 50. In the exemplary embodiment, the depression 49 is arranged on that side of the actuating plate 23 which faces toward the control drum 20. Some other arrangement of the depression 49, for example as a groove on the circumference of the actuating plate 23, may however also be advantageous. The actuating plate 23 has, on its side facing toward the control drum 20, an actuating edge 66. On that side of the actuating plate 23 which faces away from the control drum 20 there is arranged a lever 72 which is fixedly connected to the actuating plate 23 and which forms a latch element 51. Some other configuration and arrangement of the latch element 51 may also be advantageous.

Figure 5:
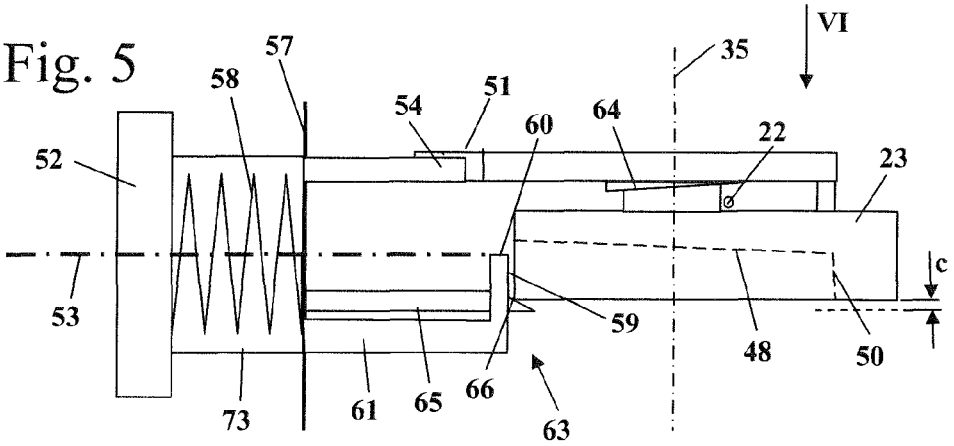
FIG. 5 shows the starter device from FIG. 4 in a starting position.

For the engagement of a starting position, the starter device 46 has an actuating element 52 which may for example be in the form of a lever or actuating button. The actuating element 52 has an actuation axis 53. The actuating element 52 is arranged adjacent to a housing wall 57 of the brushcutter 37. The housing wall 57 may in this case be any desired wall that is fixedly connected to the housing 38 of the brushcutter 37 or to the carburetor housing 19. The actuating element 52 has a guide part 73. In the operating position 47, the guide part 73 of the actuating element 52 has a spacing a to the housing wall 57. The actuating part 52 is preloaded in the direction of the operating position 47 by a spring 58. In the exemplary embodiment, the spring 58 is a spiral spring which acts as a rotary spring and compression spring between the housing wall 57 and the actuating element 52 and which is arranged on the outer circumference of the cylindrical guide part 73. The actuating element 52 has a latch element 54, which in the starting position 63 of the starter device 46 as shown in FIG. 5 interacts with the latch element 51 on the control drum 20. The actuating element 52 also has a guide element 61 which can interact with the ramp 48 and the stop element 50, and a starting enrichment pin 65 which can interact with the actuating edge 66. The illustrated configurations of the latch element 54, guide element 61 and starting enrichment pin 65 are exemplary and schematic. Any form expedient for achieving the intended function may be advantageous.

For the displacing of the actuating element 52 from the operating position 47 shown in FIG. 4 into the starting position 63 shown in FIG. 5, the actuating element 52 is first rotated about the actuation axis 53 in the direction of the arrow 55 in FIG. 4. The actuating element 52 is subsequently displaced along the actuation axis 53 in the direction of the arrow 56, and specifically is pushed in the direction of the housing wall 57. As shown in FIG. 5, in the starting position 63, the guide part 73 bears against the housing wall 57. A spacing may however also be provided between the guide part 73 and the housing wall 57. The guide part 73 advantageously has guide elements (not shown) which ensure that the actuating element 52 can be pressed into the housing 38 only in a structurally predefined position. It can be ensured in this way that the actuating element 52 must be rotated about the actuation axis 53 in the direction of the arrow 55 before the movement in the direction of the arrow 56.

As shown in FIG. 5, in the starting position 63, the starting enrichment pin 65 bears against the actuating edge 66. As a result, the carburetor drum 20 has been raised by a distance (c) schematically indicated in FIG. 5 at the actuating plate 23. Here, the distance (c) is indicated in relation to the position of the control drum 20 in FIG. 4, that is, in the operating position 47 and with the operator-controlled element 42 not actuated. During the movement of the control drum 20 in the direction of the pivot axis 35 the adjustment needle 27 shown in FIG. 3 has been pulled out of the fuel opening 28 slightly, and the free flow cross section of the annular gap 29 has increased in size. The second ramp 64 has been lifted from the guide lug 22 as a result of the raising of the control drum 20. The latch elements 51 and 54 are locked to one another, as shown in particular in FIG. 6. The spring 58 is in a stressed state.

In FIG. 6, the arrow 74 indicates the direction in which the control drum 20 is preloaded by the compression spring 25. Owing to the spring 25, the latch element 51 is pressed against the latch element 54, and the control drum 20 cannot retract of its own accord. Since the actuating element 52 is held rotationally fixedly on the housing, the actuating element 52 also cannot rotate in order to release the locking. As is also shown in FIG. 6, the guide element 61 has a guide surface 60. In the position of the arrangement shown in FIG. 6, the guide surface 60 has a spacing to the actuating plate 23 and does not bear against the latter.

Figure 7:
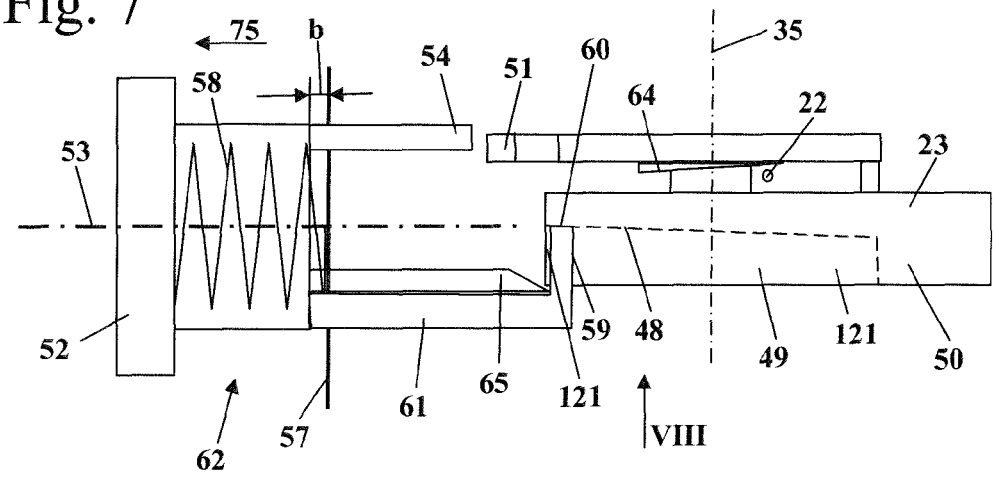
FIG. 7 shows the arrangement from FIG. 5 upon the first actuation of the operator-controlled element after the starting process.

If, proceeding from the starting position 63 shown in FIGS. 5 and 6, the operator actuates the operator-controlled element 42, that is, applies power, the control drum 20 rotates counter to the arrow 74 in FIG. 6. In the process, the latch element 51 slides off the latch element 54, and the locking is released. When the latch elements 51 and 54 have been released from one another, the actuating element 52 can move away from the housing wall 57 in the direction of the arrow 75 in FIG. 7. The guide surface 60 is arranged such that the guide surface 60 comes into contact with the first ramp 48 when the locking of the latch elements 51 and 54 has been released. Here, the guide element 61, which in the exemplary embodiment is of L-shaped form, passes behind a wall 121 that delimits the depression 49, this wall 121 also being shown in FIG. 8. The wall 121 prevents a further movement of the actuating element 52 in the direction of the arrow 75 (FIG. 7). The starter device is held in an enrichment position 62 by the wall 121. If the operator applies more power, that is, actuates the operator-controlled element 42 further, the guide surface 60 slides along the first ramp 48. The bent over end of the guide element 61, which has the guide surface 60, is in this case arranged in the depression 49 and engages behind the wall 121. In this way, the actuating element 52 is held in the enrichment position 62.

As is also shown in FIG. 7, in the enrichment position 62, the guide lug 22 continues to have a spacing with respect to the second ramp 64. The position of the control drum 20 in the longitudinal direction of the pivot axis 35 is determined, in the enrichment position 62 shown in FIGS. 7 and 8, by the first ramp 48. The actuating plate 23 no longer bears against the starting enrichment pin 65.

Figure 8:
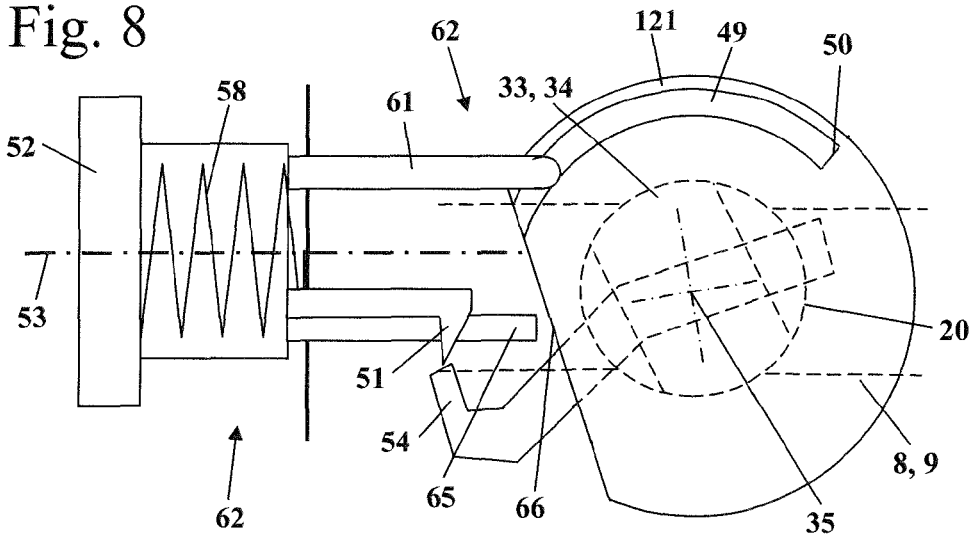
FIG. 8 shows a schematic side view in the direction of the arrow VIII in FIG. 7.

FIGS. 6 and 8 also schematically show the control drum 20 and the position of the duct sections 33 and 34 in relation to the profile of the supply ducts 8 and 9. As shown in FIG. 6, the duct sections 33 and 34 lie approximately perpendicular to the supply ducts 8 and 9. The supply ducts 8 and 9 are only slightly open. Here, the free flow cross sections opened up by the control drum 20 are smaller in the starting position 63 shown in FIG. 6 than in the enrichment position 62 shown in FIG. 8. In the enrichment position 62, the control drum 20 is further opened. The duct sections 33 and 34 in the control drum 20 are inclined to a lesser degree with respect to the longitudinal direction of the supply ducts 8 and 9 and reduce the flow cross section to a lesser extent than in the position shown in FIG. 6.

Figure 9:
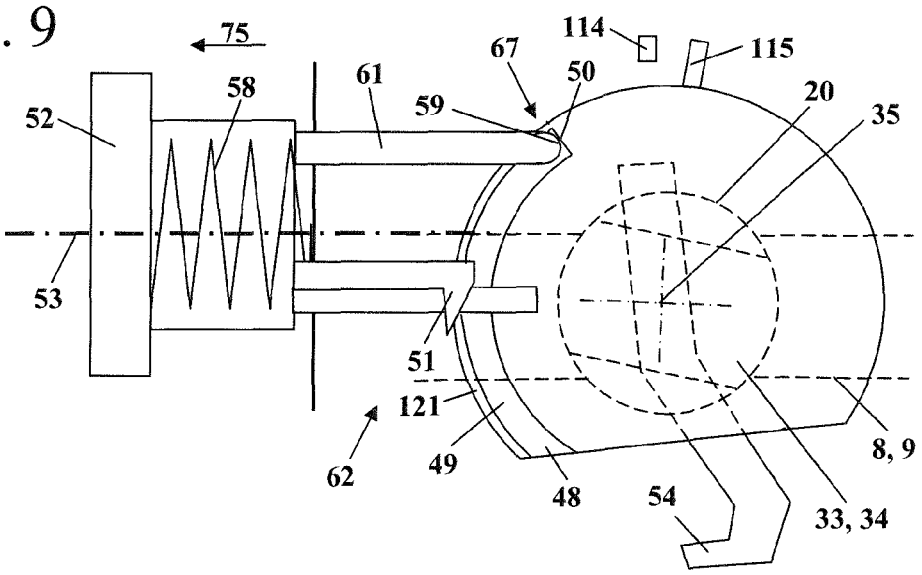
FIG. 9 shows a schematic side view as per FIG. 8 upon the first opening of the throttle element after the starting process.

If, proceeding from the enrichment position 62, the operator applies more power, the guide surface 60 slides down along the first ramp 48 until the position shown in FIG. 9 is reached. In this position, a stop element 59 formed on the guide element 61 abuts against a stop element 50 of the first ramp 48. The stop elements 50 and 59 form an intermediate stop 67 which prevents the control drum 20 from opening fully. The stop parts 114 and 115 that define the fully open position of the control drum 20 have a spacing to one another. As shown in FIG. 9, in this position, the duct sections 33 and 34 are oriented with an inclination with respect to the supply ducts 8 and 9 and reduce the flow cross section of the supply ducts 8 and 9. In the exemplary embodiment, the stop element 59 is formed on an end face of the guide element 61. The illustration in FIG. 9 is however merely schematic. Other structural configurations may also be advantageous.

If, proceeding from the position shown in FIG. 9, the operator releases the operator-controlled element 42, the control drum 20 rotates back into the non-actuated position. The guide element 61 passes out of the groove 49 and is no longer held by the wall 121. As a result, the actuating element 52 can move back in the direction of the arrow 75 into the operating position 47 shown in FIG. 4. In the process, owing to the force of the preloaded spring 58, the actuating element 52 moves in the direction of the actuation axis 53 and then rotates about the actuation axis 53.

Figure 10:
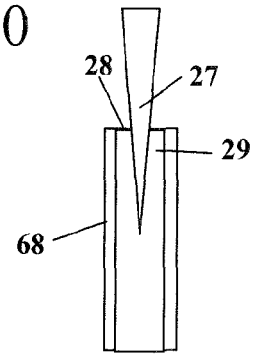
FIGS. 10 and 11 are schematics of the adjustment needle and fuel opening of the carburetor from FIG. 3 in different positions of the control drum.
Figure 11:
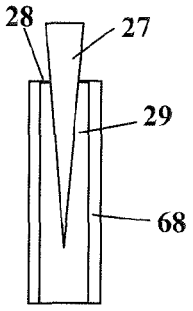

FIGS. 10 and 11 show the arrangement of the adjustment needle 27 when the control drum is fully open (FIG. 10) and when the control drum 20 is closed (FIG. 11). As shown in FIGS. 10 and 11, the fuel opening 28 is formed on a fuel pipe 68. The adjustment needle 27 projects into the fuel pipe 68. The annular gap 29 formed between the adjustment needle 27 and the fuel pipe 68 at the fuel opening 28 influences the fuel flow rate that emerges into the intake channel 26.

Figure 12:
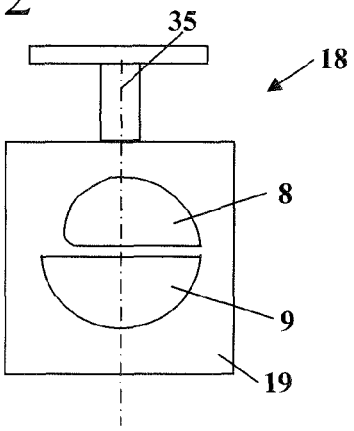
FIG. 12 shows a schematic side view of the carburetor in the direction of the arrow V in FIG. 3 in the position of the control drum shown in FIG. 9.
Figure 13:
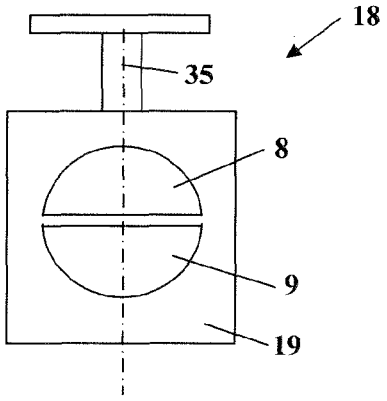
FIG. 13 shows a schematic side view of the carburetor in the direction of the arrow V in FIG. 3 in a full-throttle position.

FIGS. 12 and 13 schematically show the free flow cross sections of the two supply ducts 8, 9 in a side view of the carburetor 18. In FIG. 12, the intermediate stop 67 has been activated. The control drum 20 can be rotated only into the position shown in FIG. 9. Here, in the exemplary embodiment, the second supply duct 9 is fully open. The flow cross section of the first supply duct 8 is reduced. An enrichment of the fuel/air mixture supplied to the internal combustion engine 1 is thereby achieved. In FIG. 13, the intermediate stop 67 has been deactivated. The control drum can be opened to such an extent that the stop parts 114 and 115 (FIG. 9) bear against one another. When the control drum 20 is in the fully open position, the supply ducts 8 and 9 are fully open.

FIGS. 14 to 30 show an exemplary embodiment of a carburetor 78 with a starter device 76. FIGS. 14 to 17 show the arrangement in an operating position 77. The carburetor 78 has a carburetor housing 79 on which an air duct component 80 is held. A supply duct 9 for fuel/air mixture extends in the carburetor housing 79. In the air duct component 80 there extends a supply duct 8 for substantially fuel-free air in order to allow air to pass, as advance air, into the flow transfer channels (13, 14) of the internal combustion engine 1. The carburetor 78 is in the form of a flap-type carburetor, in particular a diaphragm-type carburetor. An air flap 85 is pivotably mounted by way of an air shaft 86 in the first supply duct 8. A throttle flap 81 is pivotably mounted by way of a throttle shaft 82, and a choke flap 83 is pivotably mounted by way of a choke shaft 84, in the second supply duct 9. In relation to the flow direction 36 to the internal combustion engine 1, as indicated in FIG. 13, the choke flap 83 is arranged upstream of the throttle flap 81. Outside the carburetor housing 79, a choke lever 91 is fixed to the choke shaft 84. In the exemplary embodiment, the choke lever 91 is fixedly connected to the choke shaft 84 so as to rotate therewith. Provision may also be made for the choke lever 91 to be spring-loaded and mounted with a small degree of play with respect to the choke shaft 84, such that tolerances can be compensated.

A throttle lever 90 is fixedly connected to the throttle shaft 82 so as to rotate therewith. In the exemplary embodiment, the throttle lever 90 is of approximately U-shaped form. The throttle lever 90 is fixedly connected to a coupling lever 89 so as to rotate therewith. The throttle lever 90 may also be formed in one piece with the coupling lever 89. The coupling lever 89 has a groove 92 which, in the exemplary embodiment, is in the form of a slot. The slot 92 is formed so as to be curved around the pivot axis of the throttle flap 81. An air flap lever 87 is fixedly connected to the air shaft 86 so as to rotate therewith. On the air flap lever 87 there is pivotably mounted a coupling lever 88 which, by way of a pin 93 shown in FIG. 16, engages into the slot 92 and thereby couples the position of the air flap 85 to the position of the throttle flap 81. Owing to the slot 92, the throttle flap 81 can perform an idle travel relative to the air flap 85. Only when the throttle flap 81 has opened by a predefined angle is the air flap 85 driven along, and likewise opened, by means of the coupling levers 88 and 89 and the air flap lever 87.

Figure 14:
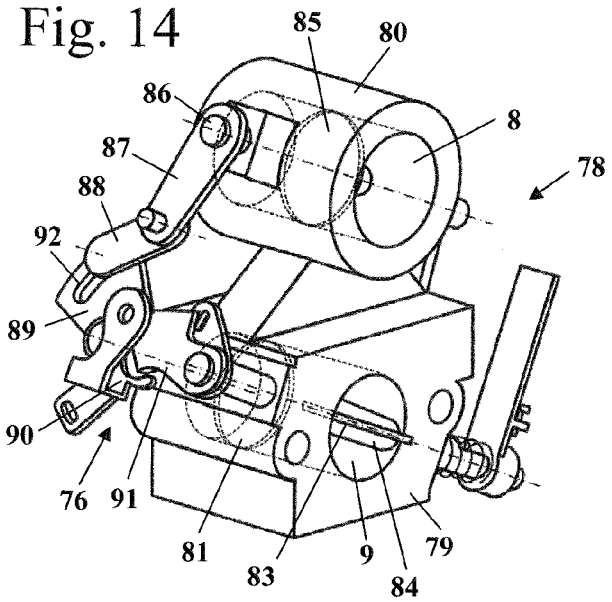
FIG. 14 is a perspective schematic of an exemplary embodiment of a carburetor in the operating position.
Figure 15:
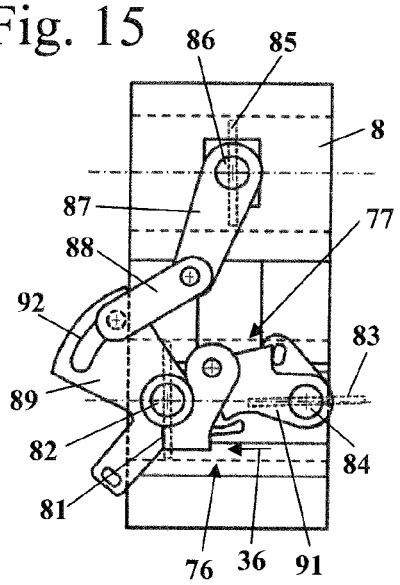
FIG. 15 shows a side view of the carburetor from FIG. 14.
Figure 16:
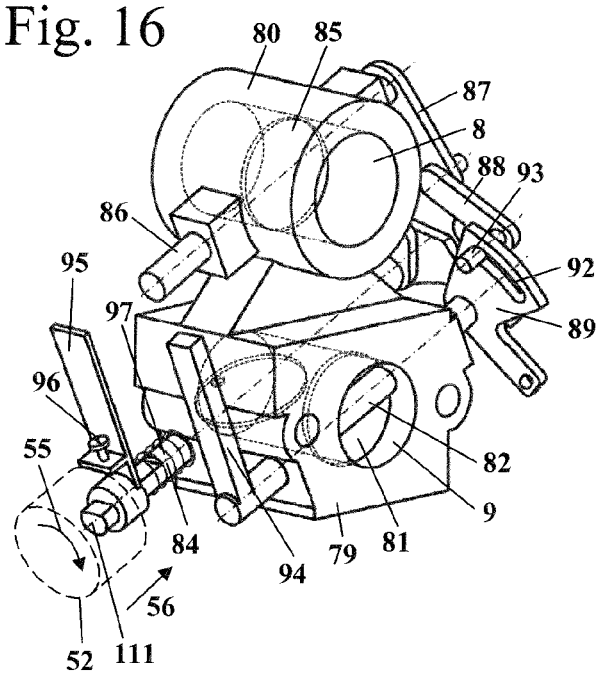
FIG. 16 is a perspective schematic of the carburetor from FIG. 14 from the opposite side of the carburetor.
Figure 17:
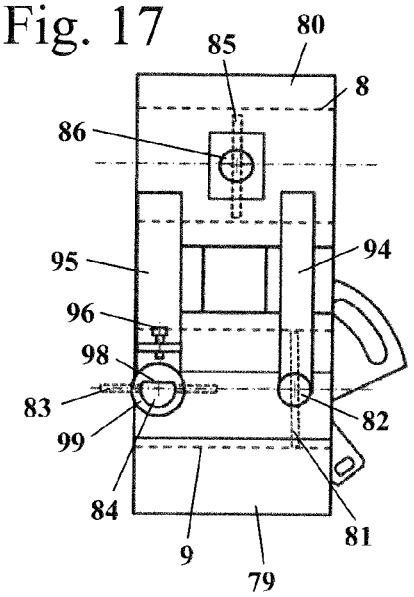
FIG. 17 shows a side elevation view of the carburetor from FIG. 16.

FIGS. 16 and 17 show the carburetor 78 from that side of the carburetor which is not visible in FIGS. 14 and 15. On the opposite side of the carburetor housing 79 in relation to the throttle lever 90, an auxiliary lever 94 is connected to the throttle shaft 82 so as to rotate therewith. In the exemplary embodiment, the auxiliary lever 94 is held fixedly on the throttle shaft 82. The auxiliary lever 94 may be formed in one piece with the throttle shaft 82. On the choke shaft 84 there is arranged an auxiliary lever 95 which is arranged so as to rotate therewith but is displaceable in the direction of the axis of rotation 111 of the choke shaft 84. The auxiliary lever 95 has a stop element 96 that will be described in greater detail below. Between the auxiliary lever 95 and the carburetor housing 79 there is arranged a spring 97 which pushes the auxiliary lever 95 into the position shown in FIG. 16. As shown in FIG. 17, the choke shaft 84 has a flattened portion 98 which is engaged on by a sleeve 99 of the auxiliary lever 95. In this way, the auxiliary lever 95 and the choke shaft 84 are connected so as to rotate with one another. The choke shaft 84 is pivotable about an axis of rotation 111.

As can be seen in FIGS. 14 to 17, in the operating position shown, in which the operator-controlled element 42 is not actuated, the throttle flap 81 and the air flap 85 are fully closed and the choke flap 83 is fully open. In their position shown in FIGS. 14 to 17, the flaps are preloaded by springs (not shown). Although the choke flap 83 and the choke shaft 84 influence the maximum possible free flow cross section in the supply duct 9, the choke flap 83 and the choke shaft 84 do not change the free flow cross section because the position of choke flap 83 and choke shaft 84 is unchanged when the starter device 76 is in the operating position.

Figure 18:
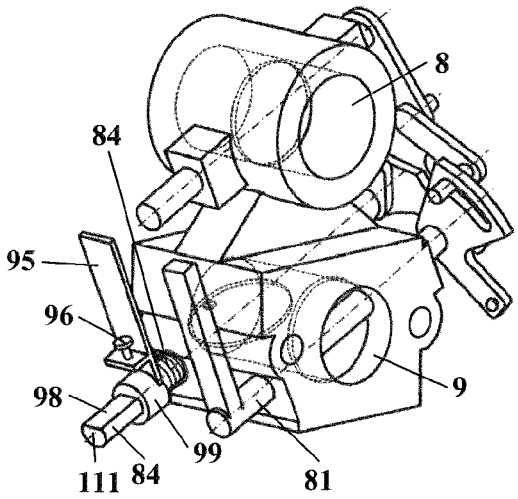
FIG. 18 shows the arrangement from FIG. 16 in a perspective view with the actuating element depressed.

The carburetor 78 has an actuating element 52 which is fixedly connected to the auxiliary lever 95. For the starting of the internal combustion engine 1, the actuating element 52 must be pushed in the direction of the housing 79 of the carburetor 78 in the direction of an arrow 56 shown in FIG. 16, and subsequently rotated about the axis of rotation 111 in the direction of the arrow 55. FIG. 18 shows the arrangement without the actuating element 52 after the movement of the actuating element 52 in the direction of the arrow 56 and before the pivoting of the actuating element 52. The auxiliary lever 95 has moved in the direction of the axis of rotation 111 in relation to the choke shaft 84.

Figure 19:
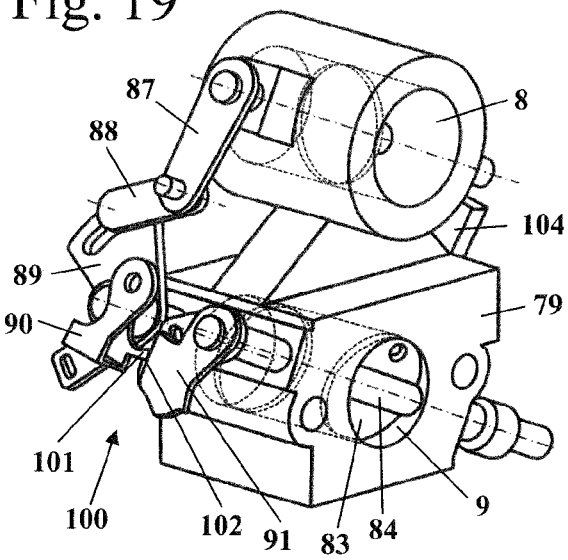
FIG. 19 is a perspective view of the arrangement from FIG. 14 in a first starting position.

FIGS. 19 to 22 show the arrangement in a first starting position 100. To set the first starting position 100, the actuating element 52 has been pivoted about the pivot axis 111 in the direction of the arrow 55 (FIG. 16) proceeding from the position shown in FIG. 18. In the process, as shown in FIG. 19, the auxiliary lever 95 abuts against that side of the auxiliary lever 94 which faces toward the carburetor housing 79. That side of the auxiliary lever 94 which faces toward the carburetor housing 79 forms a guide 104 which is partially visible in FIG. 19. The auxiliary lever 95 has a guide element 103 which bears against the guide 104. The guide element 103 is formed by that side of the auxiliary lever 95 which faces away from the carburetor housing 79. The spring 97 (FIG. 16) pushes the auxiliary lever 95 against the auxiliary lever 94. Owing to the abutment of the guide element 103 against the guide 104, the auxiliary lever 95 and the actuating element 52 cannot, despite the force of the spring 97, be displaced counter to the arrow 56 (FIG. 16) relative to the choke shaft 84 toward the side facing away from the carburetor housing 79.

Figure 20:
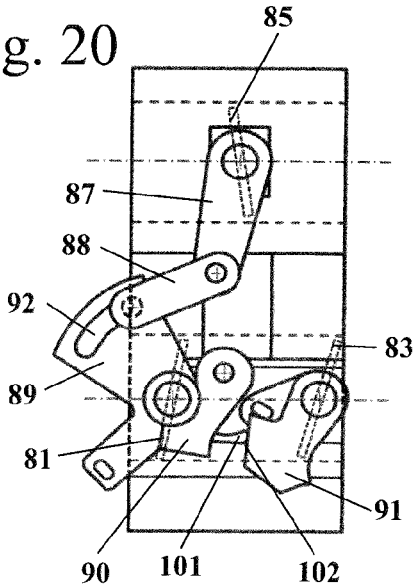
FIG. 20 shows a side view of the carburetor from FIG. 19.
Figure 21:
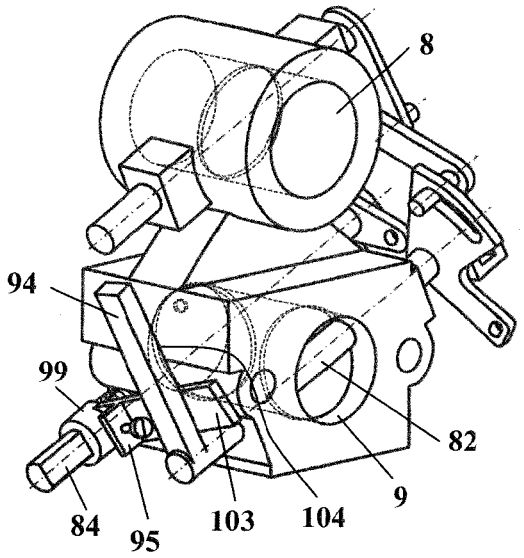
FIG. 21 shows a perspective side view of the opposite side of the carburetor.
Figure 22:
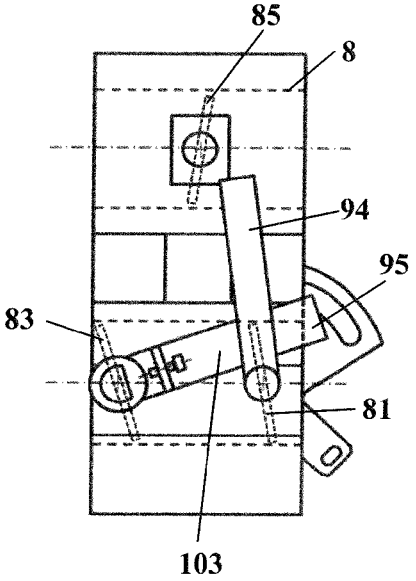
FIG. 22 shows a side view of the carburetor from FIG. 21.
Figure 23:
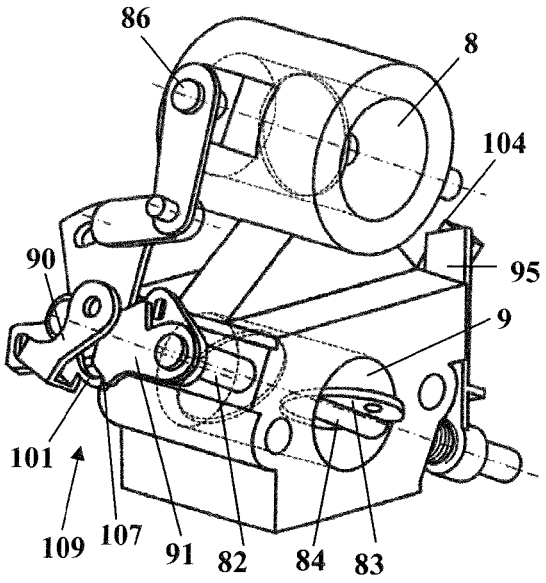
FIG. 23 shows the carburetor from FIG. 19 in a second starting position in a perspective view.

During the pivoting of the choke shaft 84 in the direction of the arrow 55, the choke lever 91 has been pivoted into the starting position 100 shown in FIGS. 19 and 20. During the pivoting process, the choke lever 91 has driven the throttle lever 90 along and likewise partially deflected the latter out of the position associated with the fully closed position of the throttle flap 81. The throttle lever 90 has a lug 101 which, during the pivoting process of the choke lever 91, slides down along the choke lever 91 into the starting position 100 shown in FIGS. 19 to 22. In the first starting position 100, which serves for the starting of the internal combustion engine 1 when the engine is cold, the lug 101 bears against an abutment surface 102 of the choke lever 91. The air flap 85 is fully closed, and the throttle flap 81 is substantially closed. The choke flap 83 is also fully closed.

Figure 24:
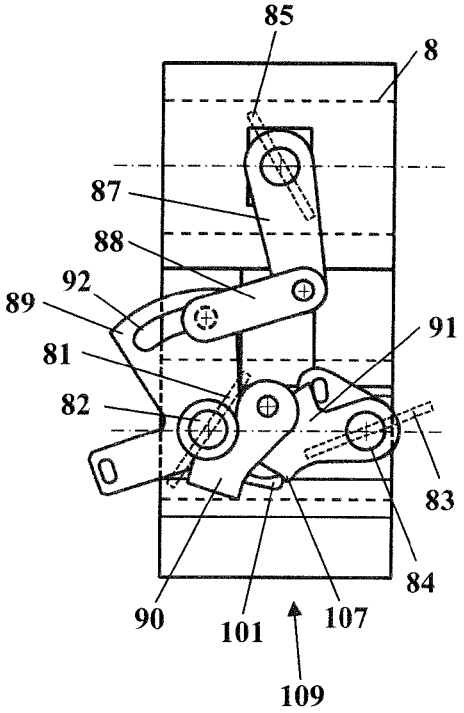
FIG. 24 shows a side view of the carburetor from FIG. 23.
Figure 25:
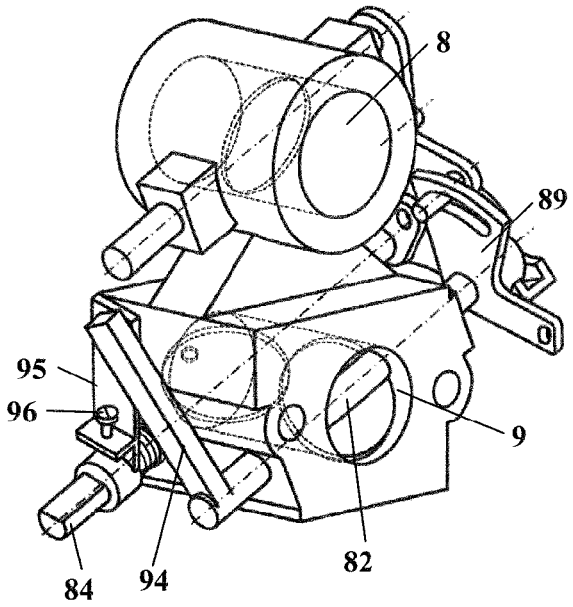
FIG. 25 is a perspective view of the opposite side of the carburetor.
Figure 26:
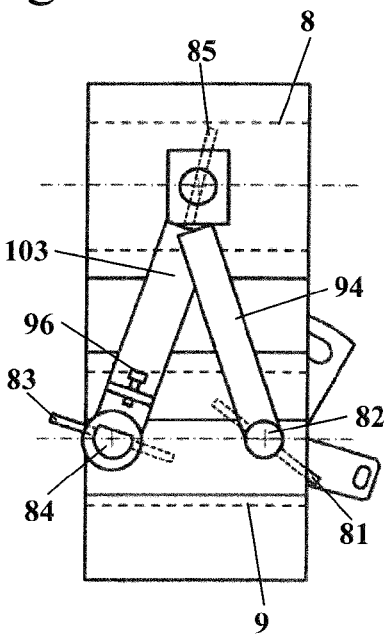
FIG. 26 shows a side view of the carburetor arrangement from FIG. 25.
Figure 27:
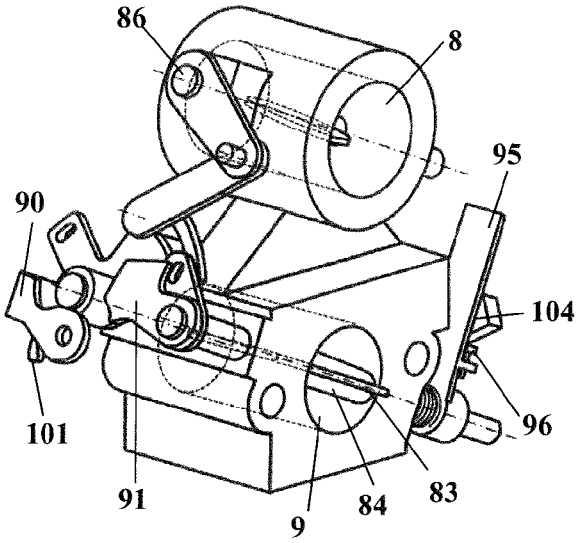
FIG. 27 is a perspective view of the carburetor from FIG. 19 upon the first application of power after the starting process.
Figure 28:
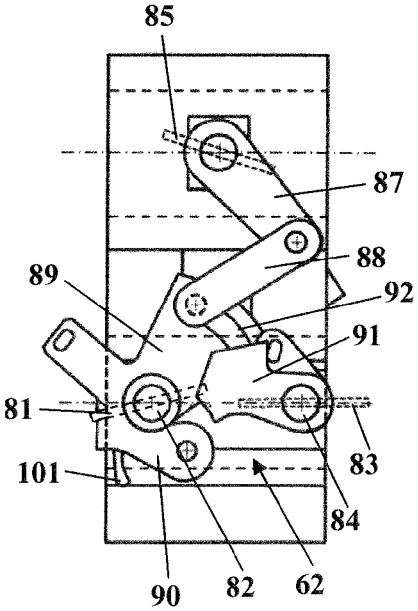
FIG. 28 shows a side view of the carburetor from FIG. 27.

FIGS. 23 to 26 show the arrangement in a second starting position 109 which serves for the starting of the internal combustion engine 1 when the internal combustion engine 1 is hot. This position may be engaged by virtue of the actuating element being pivoted counter to the arrow 55 in FIG. 16. In the second starting position 109 shown in FIGS. 23 to 26, the lug 101 of the throttle lever 90 bears against a latch elevation 107 of the choke lever 91. As shown in FIG. 24, the throttle flap 81 is partially open and the choke flap 83 is substantially open. The air flap 85 is also partially open. As shown in FIGS. 25 and 26, the auxiliary lever 95 bears against the auxiliary lever 94.

Figure 29:
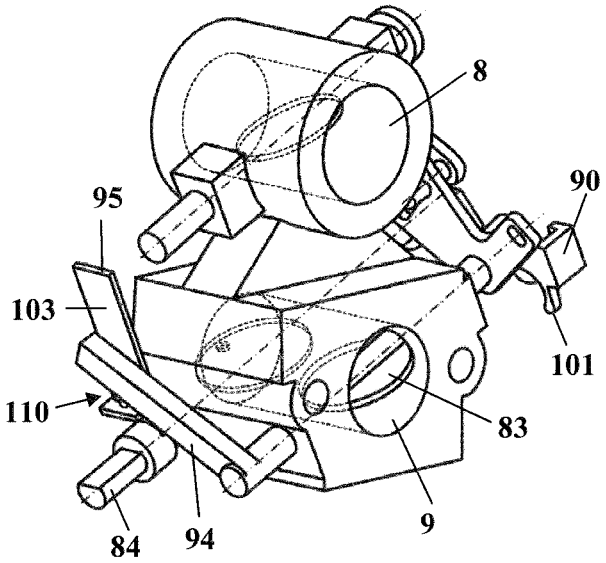
FIG. 29 is a perspective view of the opposite side of the carburetor in relation to FIG. 27.
Figure 30:
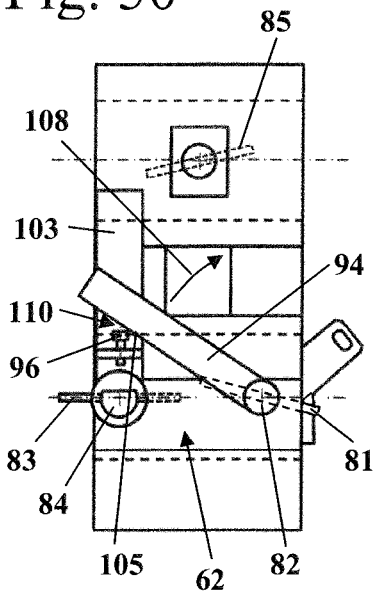
FIG. 30 shows a side view of the carburetor from FIG. 29.

FIGS. 27 to 30 show the arrangement in an enrichment position 62. The position is attained by applying power proceeding from the first starting position 100 or the second starting position 109. By applying power, that is, by actuating the operator-controlled element 42, the throttle shaft 82 is pivoted. In the process, the locking between the throttle lever 90 and choke lever 91 is released. As shown in FIGS. 29 and 30, however, the coupling lever 95 continues to bear against the coupling lever 94. The guide element 103 is held on the guide 104. The actuating element 52 is situated in the retracted position. If, in this position, the operator-controlled element 42 is fully actuated, then the throttle lever 90 pivots until the auxiliary lever 94 abuts against the stop element 96 of the auxiliary lever 95. In the process, a longitudinal side of the auxiliary lever 94 forms a stop element 105 which interacts with the stop element 96. The stop elements 96 and 105 form an intermediate stop 110 which prevents the throttle flap 81 from opening fully. In the exemplary embodiment, the stop element 96 is a screw and the position of the intermediate stop 110 can be changed by virtue of the screw being screwed in or screwed out. FIG. 30 shows the position of the throttle flap 81 when the operator-controlled element 42 is fully actuated and the intermediate stop 110 is active. The throttle flap 81 is partially closed and reduces the free flow cross section in the supply duct 9.

If, proceeding from the enrichment position 62 shown in FIGS. 27 to 30, the operator-controlled element 42 (FIG. 1) is released, then the throttle shaft 82 together with the auxiliary lever 94 pivots in the direction of the arrow 108 (FIG. 30) back into the operating position 77 shown in FIGS. 14 to 17. If the operator-controlled element 42 is then actuated again, then the intermediate stop 110 is deactivated, because the auxiliary lever 95 is no longer guided behind the auxiliary lever 94. The throttle flap 81 can be opened fully.

For the starting of the internal combustion engine 1, the first starting position 100 or the second starting position 109 may be engaged. If the first starting position 100 is engaged, then it is possible, after the starting of the internal combustion engine 1 by way of the starter handle 43, for the second starting position 109 to be set after a short period of operation. This position may be eliminated by actuation of the operator-controlled element 42, that is, by applying power. The intermediate stop 110 is active upon the subsequent first application of power after the starting process. Only during the following period of idle operation, that is, when the throttle flap 81 closes because the operator is no longer actuating the operator-controlled element 42, is the intermediate stop 110 deactivated. Alternatively, the operator may operate the internal combustion engine 1 in the first starting position 100 until the internal combustion engine 1 is hot and eliminate the locking by actuating the operator-controlled element 42. The intermediate stop 110 is active upon the subsequent application of power. The intermediate stop 110 is deactivated only upon the subsequent release of the operator-controlled element 42 and associated closure of the throttle flap 81.

Figure 31:
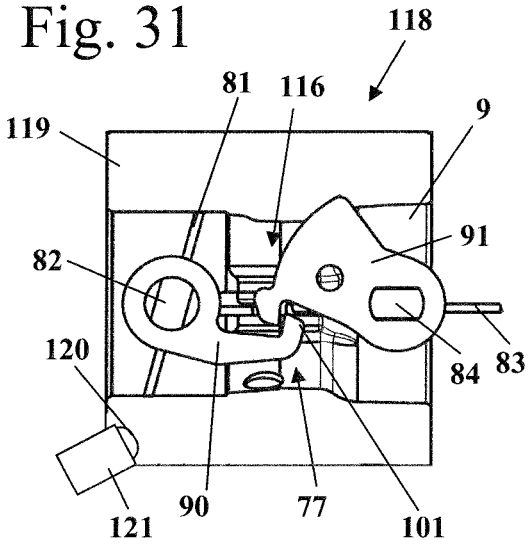
FIG. 31 shows an exemplary embodiment of a carburetor in a schematic side view in the operating position; and, FIG. 32 shows the carburetor from FIG. 31 in the starting position.
Figure 32:
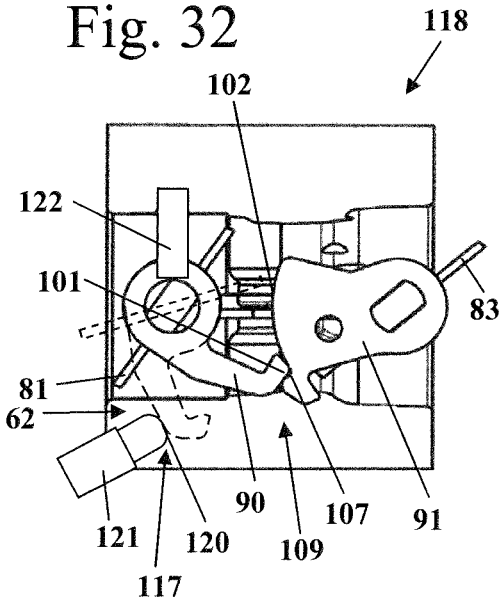

FIGS. 31 and 32 schematically show an exemplary embodiment of a carburetor 118 with a starter device 116. The carburetor 118 has a carburetor housing 119 in which a throttle flap 81 and a choke flap 83 are pivotably mounted. A throttle lever 90 with a lug 101 is fixed to the throttle shaft 82, and a choke lever 91 is fixed to the choke shaft 84. In the operating position 77 shown in FIG. 31, the choke lever 91 and throttle lever 90 do not bear against one another. If the starting position 109 shown in FIG. 32 is engaged, then the lug 101 bears against a detent elevation 107 on the choke lever 91. The throttle lever 90 and choke lever 91 thus define partially open positions of choke flap 83 and throttle flap 81. To define an enrichment position 62, the carburetor 118 has an actuator 121 with an abutment surface 120 which is merely schematically indicated in FIGS. 31 and 32. If, proceeding from the starting position 109, the throttle flap 81 is opened in order to eliminate the locking between throttle lever 90 and choke lever 91, the actuator 121 is moved into a position in which an abutment surface 120 lies in the pivoting travel of the throttle lever 90. Before the throttle flap 81 fully opens, the throttle lever 90 abuts against the stop surface 120. The stop surface 120 forms an intermediate stop 117 for the throttle flap 81. The intermediate stop 117 is deactivated after the first closure of the throttle flap 81. For this purpose, the stop surface 120 is displaced by the actuator 121 so as to no longer be situated in the pivoting travel of the throttle lever 90. The movement of the throttle flap 81 may for example be detected by means of a sensor 122, schematically indicated in FIG. 32, on the throttle shaft 82.

It is also possible in the case of the exemplary embodiment as per FIGS. 31 and 32 for a further starting position to be provided which is associated with a hot start. The same reference signs are used in all of the figures to denote mutually corresponding elements.

It is understood that the foregoing description is that of the preferred embodiments of the invention and that various changes and modifications may be made thereto without departing from the spirit and scope of the invention as defined in the appended claims.

What is claimed is:

1. An internal combustion engine comprising:

an operator-controlled element;

a supply channel for supplying combustion air for the engine;

a throttle element mounted in said supply channel;

said operator-controlled element being operatively connected to said throttle element to adjust the position thereof;

a starter device having an operating position and a starting position;

said starter device being configured to enable a defined clear flow cross section in said supply channel in said starting position;

a latching unit for latching said starter device in said starting position;

said operator-controlled element being operatively connected to said latching unit for unlatching said latching unit in response to an actuation of said operator-controlled element;

an intermediate stop configured to be active in response to a first actuation of said operator-controlled element after said latching unit is unlatched so as to prevent a full opening of said throttle element; and, said intermediate stop being further configured to be deactivated in response to a follow-on closing movement of said throttle element so as to permit said throttle element to be fully opened.

2. The internal combustion engine of claim 1, said starter device including an actuation unit actuable by an operator;

said intermediate stop including a first stop connected to said actuation unit and a second stop connected to said throttle element; and, said first stop being configured to coact with said second stop.

3. The internal combustion engine of claim 2, wherein said actuation unit defines an actuation axis and is configured to be rotatable about and displaceable along said actuation axis out from said operating position into said starting position.

4. The internal combustion engine of claim 2, wherein said actuation unit is moved at most partially in the direction of said operating position when releasing said latching unit.

5. The internal combustion engine of claim 1, wherein said starter device is configured to hold said throttle element in a partially open position in said starting position.

6. The internal combustion engine of claim 1, further comprising a guide assigned to said intermediate stop; said guide being configured to hold said intermediate stop active after the release of said latching unit until the thereafter follow-on closing movement of said throttle element.

7. The internal combustion engine of claim 6, wherein said intermediate stop is a first intermediate stop and said guide is a first guide and said engine further comprises a second intermediate stop having a second guide assigned thereto; and, said second intermediate stop is configured to be active after the deactivation of said first intermediate stop up to a thereafter follow-on closing movement of said throttle element.

8. The internal combustion engine of claim 6, further comprising a fuel port having a free flow cross section and opening into said supply channel; said guide being configured as a ramp; and, said ramp being configured to control said free flow cross section of said fuel port in dependence upon the position of said throttle element.

9. The internal combustion engine of claim 8, wherein said ramp is a first ramp; said intermediate stop is configured on said first ramp; and, wherein said engine further comprises a second ramp; said free flow cross section of said fuel port is coupled to the position of said throttle element after the deactivation of said intermediate stop; and, wherein the flow cross section adjusted based on said second ramp is less than a flow cross section adjusted for the same position of said throttle element based on said first ramp.

10. The internal combustion engine of claim 6, wherein said guide is a first guide and said engine further comprises a guide element coacting with said first guide with the first actuation of said operator-controlled element after the release of said latching unit; and, said guide element moves out of said first guide and deactivates said intermediate stop when closing said throttle element following the first actuation of said operator-controlled element.

11. The internal combustion engine of claim 6, wherein said starter device is configured to increase the fuel quantity fed into said supply channel in said starting position.

12. The internal combustion engine of claim 11, further comprising a fuel port having a free flow cross section and opening into said supply channel; and, an adjustment needle projecting into said port for controlling said fuel quantity fed in said supply channel; and, said starter device being configured to act on the position of said adjustment needle and, in said starting position, increase said free flow cross section of said fuel port.

13. The internal combustion engine of claim 12, wherein said throttle element comprises a control drum rotatably journalled about a pivot axis; said adjustment needle is held on said control drum; and, said starter device includes an actuation unit configured to move said control drum in the longitudinal direction of said pivot axis.

14. The internal combustion engine of claim 1, wherein said throttle element is a throttle flap; and, said engine further includes a choke flap arranged upstream of said throttle flap; and, said starter device is configured to act on the position of said choke flap and on the position of said throttle flap.

15. The internal combustion engine of claim 1, wherein said supply channel comprises a first supply duct for supplying combustion air and a second supply duct for supplying combustion air and fuel.

16. The internal combustion engine of claim 15, wherein said throttle element is configured to control said first supply duct and said second supply duct.

17. The internal combustion engine of claim 16, wherein said throttle element is a first throttle element controlling said second supply duct; and, wherein said engine includes an additional throttle element mounted in said first supply duct.

18. The internal combustion engine of claim 1, wherein the position of said intermediate stop is adjustable.

19. The internal combustion engine of claim 1, wherein said supply channel has a free flow cross section; and, said starter device is configured to not change said free flow cross section of said supply channel in said operating position.

* * * * *